US009919349B2

(12) United States Patent
Ito et al.

(10) Patent No.: US 9,919,349 B2
(45) Date of Patent: Mar. 20, 2018

(54) INSTRUMENT-CLEANING METHOD THAT USES SOAKING WITH NANOBUBBLE WATER

(75) Inventors: Yasushi Ito, Nagoya (JP); Koichi Aoki, Nagoya (JP); Shinichi Tokunaga, Nagoya (JP); Minoru Yoshizawa, Nishinomiya (JP)

(73) Assignees: MITSUBISHI HEAVY INDUSTRIES MACHINERY SYSTEMS, LTD., Kobe-shi (JP); Minoru Yoshizawa, Nishinomiya-shi (JP)

( * ) Notice: Subject to any disclaimer, the term of this patent is extended or adjusted under 35 U.S.C. 154(b) by 939 days.

(21) Appl. No.: 13/637,724

(22) PCT Filed: Aug. 18, 2011

(86) PCT No.: PCT/JP2011/068685
§ 371 (c)(1),
(2), (4) Date: Sep. 27, 2012

(87) PCT Pub. No.: WO2012/029552
PCT Pub. Date: Mar. 8, 2012

(65) Prior Publication Data

US 2013/0019902 A1 Jan. 24, 2013

(30) Foreign Application Priority Data

Aug. 30, 2010 (JP) ..... 2010-192619

(51) Int. Cl.
*B08B 3/12* (2006.01)
*B08B 9/027* (2006.01)
*B67C 3/00* (2006.01)

(52) U.S. Cl.
CPC ..... *B08B 3/12* (2013.01); *B08B 9/027* (2013.01); *B08B 2203/005* (2013.01); *B67C 3/001* (2013.01)

(58) Field of Classification Search
None
See application file for complete search history.

(56) References Cited

U.S. PATENT DOCUMENTS 6,227,215 B1 * 5/2001 Akazawa ..... B08B 9/0323 134/103.1
6,454,871 B1 * 9/2002 Labib ..... A61C 1/0076 134/22.12
2007/0062555 A1 3/2007 Chang et al.

FOREIGN PATENT DOCUMENTS

CN 1939609 A 4/2007
DE 10129642 A1 1/2002
JP 63-281992 A 11/1988
JP 01-267196 A 10/1989
(Continued)

OTHER PUBLICATIONS

JP2009-136852 English Translation, accessed on Jul. 2015.*
(Continued)

*Primary Examiner* — Eric W Golightly
*Assistant Examiner* — Arlyn I Rivera-Cordero
(74) *Attorney, Agent, or Firm* — Westerman, Hattori, Daniels & Adrian, LLP

(57) ABSTRACT

A cleaning method is provided for on-site cleaning of equipment such as filling equipment that fills beverages, etc. into bottles, cans, and other containers, liquid treatment equipment for filling solutions, and pipe equipment for connecting said equipment, the method being able to increase significantly the cleanliness of portions in contact with the filling solution while shortening cleaning time and reducing the amount used of utilities such as cleaning solution, etc. In the cleaning method for on-site cleaning of the liquid pathways of equipment such as filling equipment (4) for filling beverages into bottles, cans and other containers, liquid-treatment equipment (3) for filling solutions, or pipe equipment (4*p*) that connects said equipment, liquid
(Continued)

comprising nanobubbles is pumped into said equipment and is left undisturbed to soak for a prescribed period.

20 Claims, 5 Drawing Sheets

(56) References Cited

FOREIGN PATENT DOCUMENTS

| | | | |
|---|---|---|---|
| JP | 08-091490 | A | 4/1996 |
| JP | 2001-009401 | A | 1/2001 |
| JP | 2002-151459 | A | 5/2002 |
| JP | 2005-245817 | A | 9/2005 |
| JP | 2006-289183 | A | 10/2006 |
| JP | 2007-236706 | A | 9/2007 |
| JP | 2007-331801 | A | 12/2007 |
| JP | 2009-136852 | A | 6/2009 |
| JP | 2010-137134 | A | 6/2010 |
| JP | 2011-230106 | A | 11/2011 |
| JP | 2011-255271 | A | 12/2011 |
| WO | 2006/001293 | A1 | 1/2006 |
| WO | 2011/158957 | A1 | 12/2011 |

OTHER PUBLICATIONS

JP2001-009401 English Translation, accessed on Jul. 2015.*

Korean Notice of Allowance dated Jun. 17, 2014, issued in Korean Patent Application No. 10-2012-7025269, w/ English translation (4 pages).

International Search Report of PCT/JP2011/068685, dated Sep. 27, 2011.

Written Opinion of PCT/JP2011/068685, dated Sep. 27, 2011.

Extended European Search Report dated Aug. 18, 2014, issued in European Patent Application No. 11821569.8 (6 pages).

Japanese Notice of Allowance dated Mar. 18, 2014, issued in Japanese Patent Application No. 2010-192619, w/ English translation (6 pages).

Korean Office Action dated Jan. 29, 2014, issued in corresponding Korean application No. 10-2012-7025269, w/ English translation (8 pages).

Office Action dated Dec. 2, 2013, issued in corresponding Chinese application No. 201180016194.9, w/ English translation.

Decision to Grant a Patent dated Sep. 8, 2016, issued in counterpart European Patent Application No. 11821569.8. (3 pages).

* cited by examiner

INSTRUMENT-CLEANING METHOD THAT USES SOAKING WITH NANOBUBBLE WATER

TECHNICAL FIELD

The present invention relates to an instrument-cleaning method of cleaning equipment such as filling equipment that fills beverages, etc. into containers, such as bottles and cans, liquid-treatment equipment for filling solutions, or pipe equipment that connects these pieces of equipment, when cleaning such as on-site cleaning is performed after the end of production or before the start of production.

Priority is claimed on Japanese Patent Application No. 2010-192619, filed Aug. 30, 2010, the content of which is incorporated herein by reference.

BACKGROUND ART

When on-site cleaning of liquid pathways of equipment such as filling equipment that fills beverages, etc. into containers, such as bottles and cans, liquid-treatment equipment for filling solutions, or pipe equipment that connects these pieces of equipment is performed after the end of production or before the start of production, cleaning is performed through the circulation of hot water or single rinsing, and the circulation of chemicals such as acids or caustic solutions.

In recent years, it has become apparent that cleaning effects and the like can be improved when small bubbles (nanobubbles) having a diameter of 1 micrometer (μm) or less are contained in cleaning liquid, and research on the generation of nanobubbles has been performed (Patent Document 1).

PRIOR ART DOCUMENTS

Patent Documents

Patent Document 1: Japanese Unexamined Patent Application, First Publication No. 2006-289183 (FIGS. 1 to 10)

SUMMARY OF INVENTION

Problem to be Solved by the Invention

An on-site cleaning method in the related art of equipment such as filling equipment that fills beverages, etc. into containers, such as bottles and cans, liquid-treatment equipment for filling solutions, or pipe equipment that connects these pieces of equipment will be described with reference to FIGS. 5 and 6.

FIG. 5 is a schematic flow diagram illustrating an instrument-cleaning method in the related art.

FIG. 6 is a view illustrating the contamination of a pipe-connecting portion of FIG. 5 after cleaning.

FIG. 5 shows hot water circulation where hot water is fed to liquid-treatment equipment 3, pipe equipment 4*p*, and filling equipment 4 from a hot water cleaning solution tank 7 through a switching valve V7 and a heating device 8 by a pump P7 as shown by an arrow in FIG. 5 on the basis of control commands sent from a control device 17 after the end of filling/production and is returned to the hot water cleaning solution tank 7 through a switching valve V10 by a pump P4; or a hot water rinsing process for discharging hot water to the outside of a system from a switching valve V11 through the switching valve V10, a switching valve V9, and a switching valve V8 in the direction of an arrow E is performed first for a prescribed period in the on-site cleaning of the liquid-treatment equipment 3, the filling equipment 4, and the pipe equipment 4*p*. After that, acid cleaning solution circulation is performed for a prescribed period. In the acid cleaning solution circulation, an acid cleaning solution is fed to the liquid-treatment equipment 3, the pipe equipment 4*p*, and the filling equipment 4 from an acid cleaning solution tank 6 through a switching valve V6, the switching valve V7, and the heating device 8 by the pump P7 as shown by the arrow in FIG. 5 on the basis of control commands sent from the control device 17 and is returned to the acid cleaning solution tank 6 through the switching valve V10 and the switching valve V9 by the pump P4. After that, the above-mentioned hot water circulation or the above-mentioned hot water rinsing process is performed for a prescribed period on the basis of control commands sent from the control device 17. Then, after caustic cleaning solution circulation is performed for a prescribed period, the above-mentioned hot water circulation or the above-mentioned hot water rinsing process is performed for a prescribed period on the basis of control commands sent from the control device 17. In the caustic cleaning solution circulation, a caustic cleaning solution is fed to the liquid-treatment equipment 3, the pipe equipment 4*p*, and the filling equipment 4 from a caustic cleaning solution tank 5 through a switching valve V5, the switching valve V7, and the heating device 8 by the pump P7 as shown by the arrow in FIG. 5 on the basis of control commands sent from the control device 17 and is returned to the caustic cleaning solution tank 5 through the switching valve V10, the switching valve V9, and the switching valve V8 by the pump P4.

Meanwhile, in the liquid-treatment equipment 3, the filling equipment 4, and the pipe equipment 4*p* for connecting these pieces of equipment, a ferrule 31*h* and a ferrule 32*h* for connecting a pipe 31 with a pipe 32 are liquid-tightly connected to each other by a ferrule joint 34 with an O-ring 33 interposed therebetween.

However, since a gap 35 is formed between the ferrule 31*h* and the ferrule 32*h* at the connecting portion of the pipe equipment 4*p* in the on-site cleaning in the related art shown in FIGS. 5 and 6, there is a concern that the cleaning of the gap 35 is not sufficiently performed. In particular, since a portion 35*p* of the gap 35 facing the O-ring 33 is not sufficiently cleaned, there is a concern that this is unhygienic in terms of food hygiene. Meanwhile, the cleaning of the gap at the connecting portion of the pipe equipment 4*p* has been described in the above description. However, since the cleaning of gaps at the connecting portions or the like of the liquid pathways of the liquid-treatment equipment or the filling equipment is also the same as described above, the detailed description thereof will be omitted.

Further, according to Patent Document 1, liquid containing large bubbles having a diameter of 1 micrometer (μm) or more is supplied to a storage tank and ultrasonic vibration is applied to the liquid by an ultrasonic vibration device, so that nanobubbles are generated.

However, the technique of Patent Document 1 discloses a technique relating to the generation of nanobubbles, but does not disclose a technique for cleaning equipment, such as filling equipment for filling lines, liquid-treatment equipment, or pipe equipment for connecting these pieces of equipment, by using liquid that contains nanobubbles.

An object of the invention is to provide an instrument-cleaning method for on-site cleaning of equipment such as filling equipment that fills beverages, etc. into containers, such as bottles and cans, liquid-treatment equipment for filling solutions, or pipe equipment for connecting the equipment, the method being able to increase significantly the cleanliness of portions in contact with the filling solution while shortening cleaning time and reducing the amount of used utilities such as cleaning solution, etc.

Means for Solving the Problem

The invention is contrived to solve the above-mentioned problem by the following means.

According to an aspect of the invention, an instrument-cleaning method is provided for on-site cleaning of liquid pathways of filling equipment that fills beverages, etc. into containers, such as bottles and cans, liquid-treatment equipment for filling solutions, or pipe equipment that connects the filling equipment and the liquid-treatment equipment. The instrument-cleaning method includes pumping liquid containing nanobubbles into the liquid pathways, and leaving the liquid undisturbed to soak for a prescribed period while filling the liquid pathways with the liquid after the pumping of the liquid containing nanobubbles.

By the above-mentioned setup, it is possible to perform cleaning to achieve high cleanliness by the action of the adsorption and separation of contaminants, attached to the liquid pathways, by nanobubbles, and to shorten on-site cleaning time. Further, if chemicals and the like are not used, post-treatment such as neutralization required when chemicals are used is not needed since nanobubbles are formed of small bubbles of air, a nitrogen gas, or the like.

In the instrument-cleaning method according to the aspect, the liquid may be water.

By the above-mentioned structure, it is possible to perform cleaning to achieve high cleanliness by the action of the adsorption and separation of contaminants attached to the liquid pathways that are caused by nanobubbles, and to shorten on-site cleaning time. Further, if chemicals and the like are not used, post-treatment such as neutralization required when chemicals are used is not needed since nanobubbles are formed of small bubbles of air, a nitrogen gas, or the like.

Furthermore, the instrument-cleaning method according to the aspect may further include cleaning the liquid pathways with a chemical after leaving the liquid undisturbed to soak.

By the above-mentioned structure, it is possible to perform cleaning to achieve high cleanliness by the action of the adsorption and separation of contaminants attached to the liquid pathways that are caused by nanobubbles, and to shorten on-site cleaning time. Moreover, it is possible to reduce the amount of used chemical or the like at the time of the on-site cleaning.

Further, in the instrument-cleaning method according to the aspect, the prescribed period of leaving the liquid undisturbed to soak may be in the range of 1 to 30 minutes.

By the above-mentioned structure, it is possible to efficiently clean the equipment.

Furthermore, in the instrument-cleaning method according to the aspect, a gas forming the nanobubbles may be ozone gas.

By the above-mentioned structure, a bactericidal action and a deodorizing action are added.

Moreover, ultrasonic vibration may be applied to the liquid containing nanobubbles or the nanobubble water in leaving the liquid undisturbed to soak.

By the above-mentioned structure, it is possible to reliably perform cleaning to achieve high cleanliness.

Advantageous Effects of Invention

According to an aspect of the invention, in an instrument-cleaning method for on-site cleaning of liquid pathways of equipment, such as filling equipment that fills beverages, etc. into containers, such as bottles and cans, liquid-treatment equipment for filling solutions, or pipe equipment that connects the equipment, liquid containing nanobubbles is pumped into the equipment and the liquid is left undisturbed to soak for a prescribed period, water (nanobubble water) is used as the liquid containing the nanobubbles, and the liquid containing the nanobubbles or the nanobubble water is left in the equipment undisturbed to soak as a pre-process of the cleaning of the equipment using a chemical. Accordingly, the instrument-cleaning method can perform cleaning to achieve high cleanliness by the action of the adsorption and separation of contaminants attached to the liquid pathways that are caused by nanobubbles, and shorten on-site cleaning time. Moreover, the instrument-cleaning method has an effect of being capable of reducing the amount of used chemical or the like at the time of the on-site cleaning.

Further, since nanobubbles are formed of small bubbles of air, a nitrogen gas, or the like, in the case of equipment cleaning without using a chemical or the like, there is an effect that post-treatment such as neutralization required when chemicals are used is not needed.

Furthermore, in the instrument-cleaning method according to the aspect of the invention, the prescribed period of leaving the liquid containing the nanobubbles or the nanobubble water undisturbed to soak is in the range of 1 to 30 minutes. Accordingly, the instrument-cleaning method has an effect of being capable of efficiently cleaning the equipment.

Moreover, in the instrument-cleaning method according to the aspect of the invention, a gas forming the nanobubbles is ozone gas. Accordingly, the instrument-cleaning method has an effect of adding a bactericidal action and a deodorizing action.

Further, in the instrument-cleaning method according to the aspect of the invention, ultrasonic vibration is applied to the liquid containing nanobubbles or the nanobubble water in leaving the liquid undisturbed to soak. Accordingly, the instrument-cleaning method has an effect of being capable of reliably performing cleaning to achieve high cleanliness.

MODE FOR CARRYING OUT THE INVENTION

Embodiments of the invention will be described in detail below with reference to the drawings. Meanwhile, the invention is not limited to these embodiments. Further, components that can be easily supposed by those skilled in the art, or substantially the same components are included in components of the following embodiments.

First Embodiment of the Invention

A first embodiment of the invention will be described with reference to FIG. 1.

Figure 1:
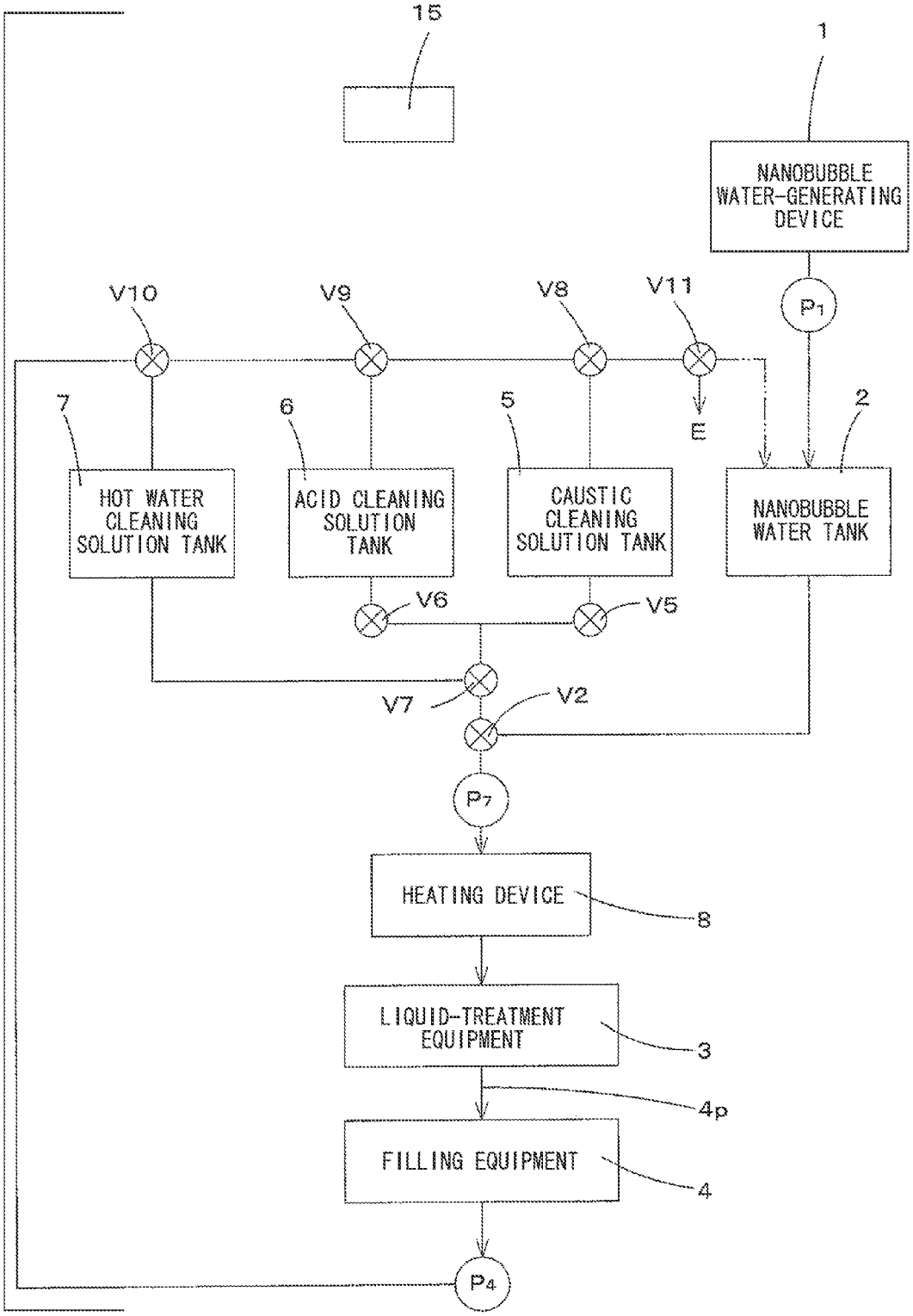
FIG. 1 is a schematic flow diagram illustrating an instrument-cleaning method according to a first embodiment of the invention, and shows only main parts.

FIG. 1 is a schematic flow diagram illustrating an instrument-cleaning method according to a first embodiment of the invention, and shows only main parts.

Figure 2:
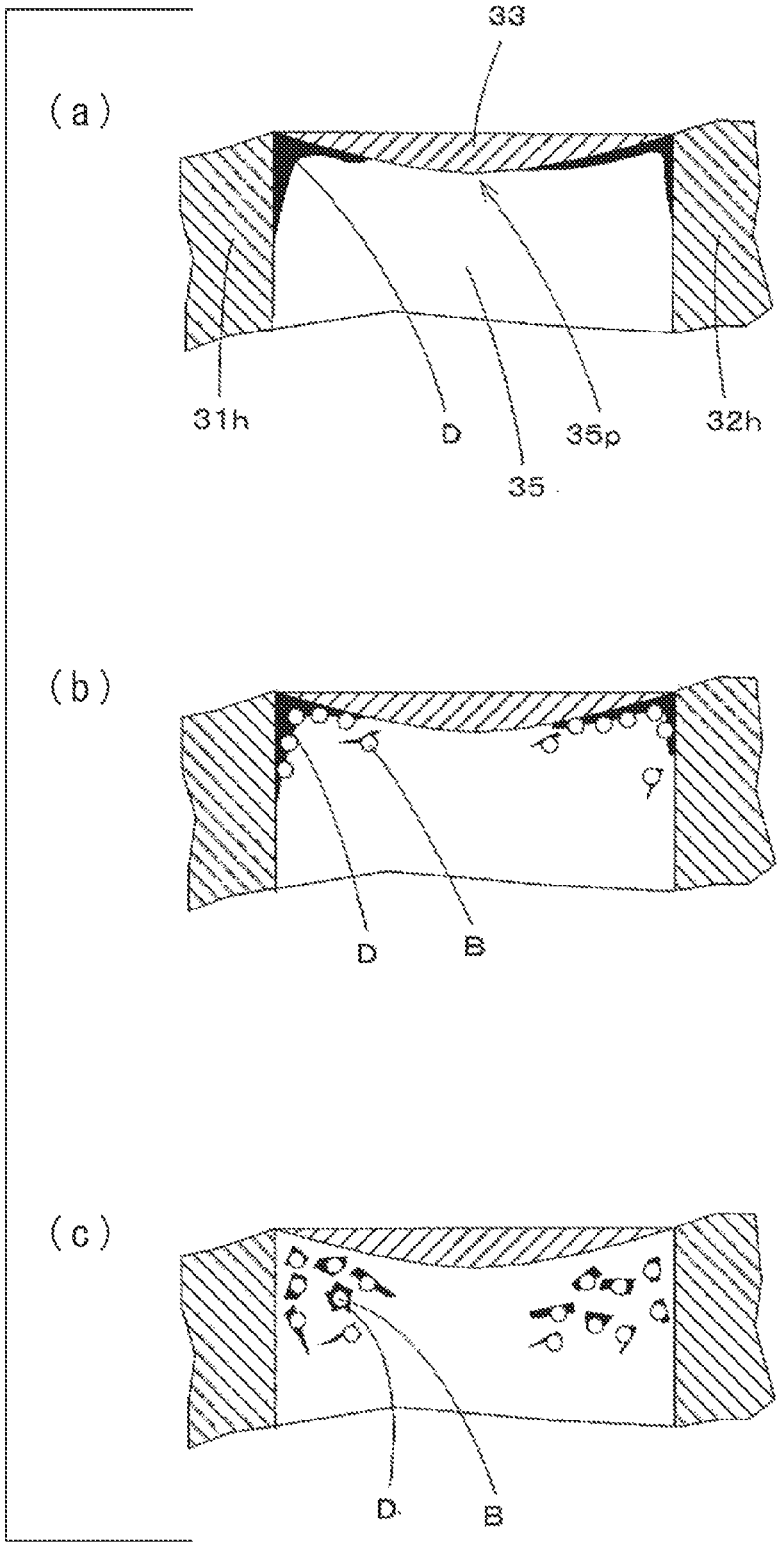
FIG. 2 is a view that shows contaminated portions of a pipe-connecting portion in a gap and is used to illustrate the cleaning action generated by the soaking of nanobubble water of the invention and is a view corresponding to a partially enlarged view of FIG. 6, FIG. 2(*a*) is a view showing a state where the surfaces of equipment before cleaning are contaminated, FIG. 2(*b*) is a view showing a state where nanobubbles are adsorbed to contaminants by the soaking of the nanobubble water, and FIG. 2(*c*) is a view showing a state where contaminants are separated from the contaminated portions of the equipment by the nanobubbles.
Figure 6:
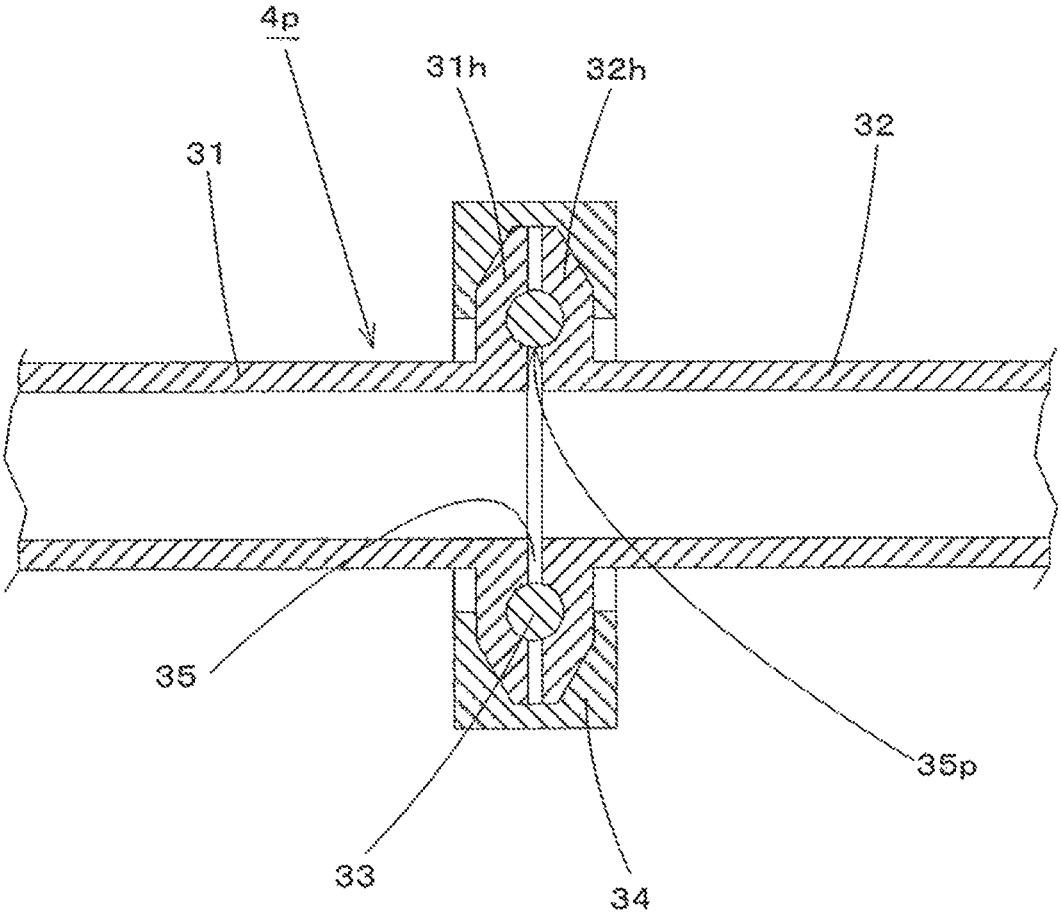
FIG. 6 is a view illustrating the contamination of a pipe-connecting portion of FIG. 5 after equipment cleaning.

FIG. 2 is a view that shows contaminated portions of a pipe-connecting portion in a gap and is used to illustrate the cleaning action generated by the soaking of nanobubble water of the invention and is a view corresponding to a partially enlarged view of FIG. 6, FIG. 2(*a*) is a view showing a state where the surfaces of equipment before cleaning are contaminated, FIG. 2(*b*) is a view showing a state where nanobubbles are adsorbed to contaminants by the soaking of the nanobubble water, and FIG. 2(*c*) is a view showing a state where contaminants are separated from the contaminated portions of the equipment by the nanobubbles.

Figure 5:
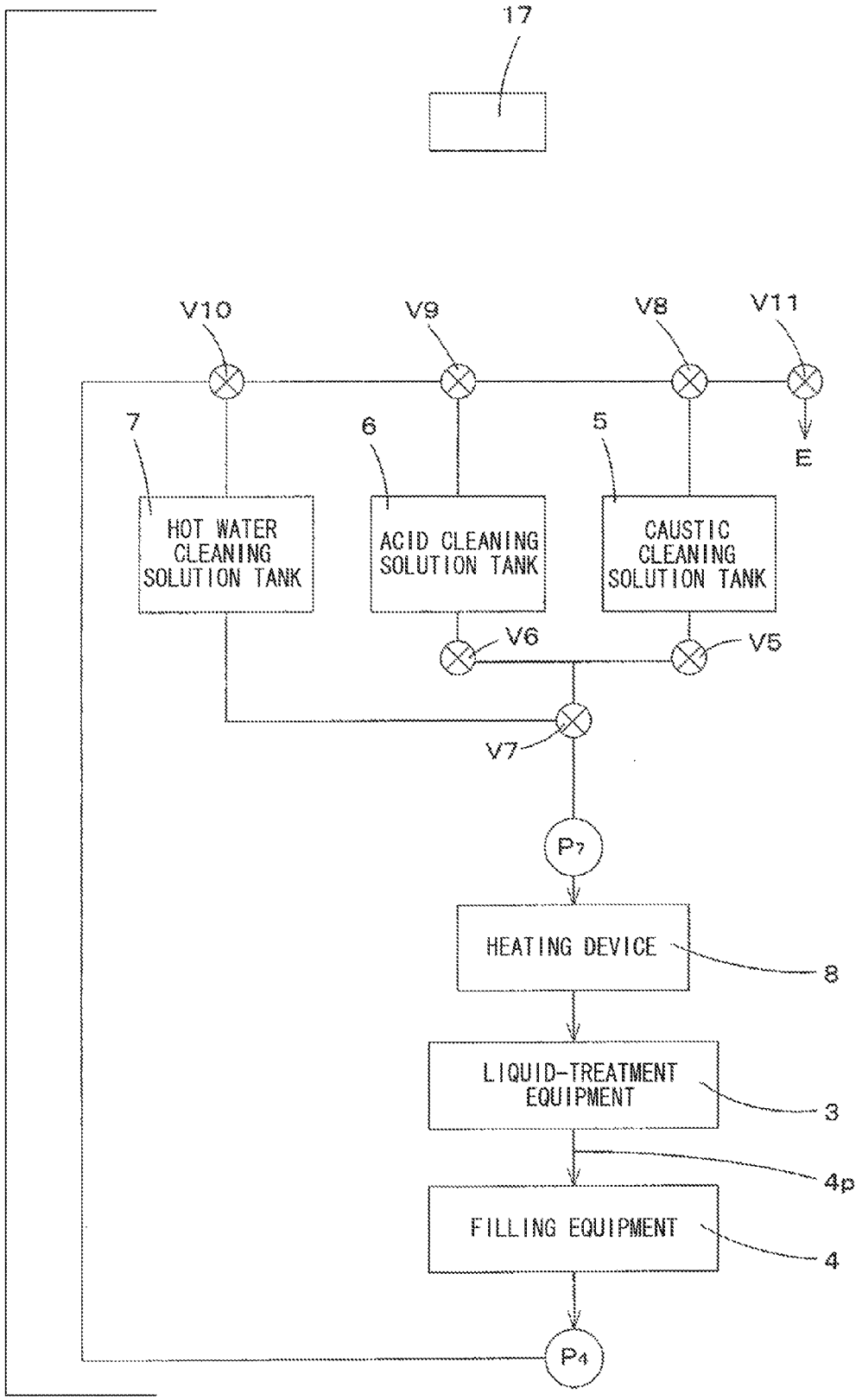
FIG. 5 is a schematic flow diagram illustrating an instrument-cleaning method in the related art, and shows only main parts.

The same portions of FIGS. 1 and 2 as the portions of FIGS. 5 and 6 are denoted by the same reference numerals, and repeated description thereof will be omitted.

Nanobubble water generated by a nanobubble water-generating device 1 is fed to a nanobubble water tank 2 by a pump P1 and is stored in the nanobubble water tank 2.

Since the nanobubble water-generating device 1 is disclosed in JP-A-2006-289183 and the like, the detailed description thereof will be omitted here.

Hot water circulation where hot water is fed to liquid-treatment equipment 3, pipe equipment 4*p*, and filling equipment 4 from a hot water cleaning solution tank 7 through a switching valve V7, a switching valve V2, and a heating device 8 by a pump P7 as shown by arrows in FIG. 1 on the basis of control commands sent from a control device 15 after the end of filling/production and is returned to the hot water cleaning solution tank 7 through a switching valve V10 by a pump P4; or a hot water rinsing process for discharging hot water to the outside of a system from a switching valve V11 through the switching valve V10, a switching valve V9, and a switching valve V8 in the direction of an arrow E is performed for a prescribed period in the on-site cleaning of the liquid-treatment equipment 3, the filling equipment 4, and the pipe equipment 4*p*. After that, nanobubble water is fed to the liquid-treatment equipment 3, the pipe equipment 4*p*, and the filling equipment 4 from the nanobubble water tank 2 through the switching valve V2 and the heating device 8 by the pump P7 as shown by arrows in FIG. 1 on the basis of control commands sent from the control device 15; and the liquid-treatment equipment 3, the pipe equipment 4*p*, and the filling equipment 4 are soaked in the nanobubble water. The nanobubble water, in which liquid pathways of the liquid-treatment equipment 3, the pipe equipment 4*p*, and the filling equipment 4 are soaked for a prescribed period (a period varies depending on products), is discharged to the outside of the system from the switching valve V11 through the switching valve V10, the switching valve V9, and the switching valve V8 in the direction of an arrow E by a pump P4 on the basis of control commands sent from the control device 15.

Meanwhile, there may also be a case where the nanobubble water in which the liquid pathways of the liquid-treatment equipment 3, the pipe equipment 4*p*, and the filling equipment 4 are soaked for a prescribed period is returned to the nanobubble water tank 2 through the switching valve V10, the switching valve V9, the switching valve V8, and the switching valve V11 according to the intended use by the pump P4 as shown in FIG. 1 by a two-dot chain line. However, the detailed description thereof will be omitted.

After that, acid cleaning solution circulation is performed for a prescribed period. In the acid cleaning solution circulation, an acid cleaning solution is fed to the liquid-treatment equipment 3, the pipe equipment 4*p*, and the filling equipment 4 from an acid cleaning solution tank 6 through a switching valve V6, the switching valve V7, the switching valve V2, and the heating device 8 by the pump P7 as shown by arrows in FIG. 1 on the basis of control commands sent from the control device 15 and is returned to the acid cleaning solution tank 6 through the switching valve V10 and the switching valve V9 by the pump P4. After that, the above-mentioned hot water circulation or the above-mentioned hot water rinsing process is performed for a prescribed period. Then, caustic cleaning solution circulation is performed for a prescribed period. In the caustic cleaning solution circulation, a caustic cleaning solution is fed to the liquid-treatment equipment 3, the pipe equipment 4*p*, and the filling equipment 4 from a caustic cleaning solution tank 5 through a switching valve V5, the switching valve V7, the switching valve V2, and the heating device 8 by the pump P7 as shown by arrows in FIG. 1 on the basis of control commands sent from the control device 15 and is returned to the caustic cleaning solution tank 5 through the switching valve V10, the switching valve V9, and the switching valve V8 by the pump P4. After that, the above-mentioned hot water circulation or the above-mentioned hot water rinsing process is performed for a prescribed period on the basis of control commands sent from the control device 15.

Meanwhile, the heating device 8 heats the cleaning solution or the like up to a predetermined temperature by the commands sent from the control device 15, as necessary. However, the detailed description thereof will be omitted.

Next, the action of the instrument-cleaning method according to the first embodiment of the invention will be described.

First, the cleaning action generated by the soaking of the nanobubble water will be described with reference to FIG. 2.

In the soaking of the nanobubble water for 10 minutes, contaminants D such as coffee grounds, which are shown in FIG. 2(*a*) and adhered on the surface of equipment, are adsorbed to nanobubbles B by the absorption action of the nanobubbles as shown in FIG. 2(*b*), and the contaminants D are gradually separated from the surface of the equipment together with the nanobubbles B as shown in FIG. 2(*c*) and are washed away by the circulation cleaning of the acid cleaning solution after the separation.

Meanwhile, a case where an acid and a caustic solution are used as a chemical for the on-site cleaning has been described in the above description. However, there may be a case where only one of an acid and a caustic solution is used, a case where neither an acid nor a caustic solution is used, and a case where other chemicals different from an acid and a caustic solution are used. The chemicals for the on-site cleaning are selected depending on the contamination or the like that are an object of the on-site cleaning, but the detailed description thereof will be omitted.

Next, experimental results of the case of the instrument-cleaning method in the related art and the case of the equipment cleaning of the invention to which the soaking of the nanobubble water is added will be described with reference to FIG. 3.

Figure 3:
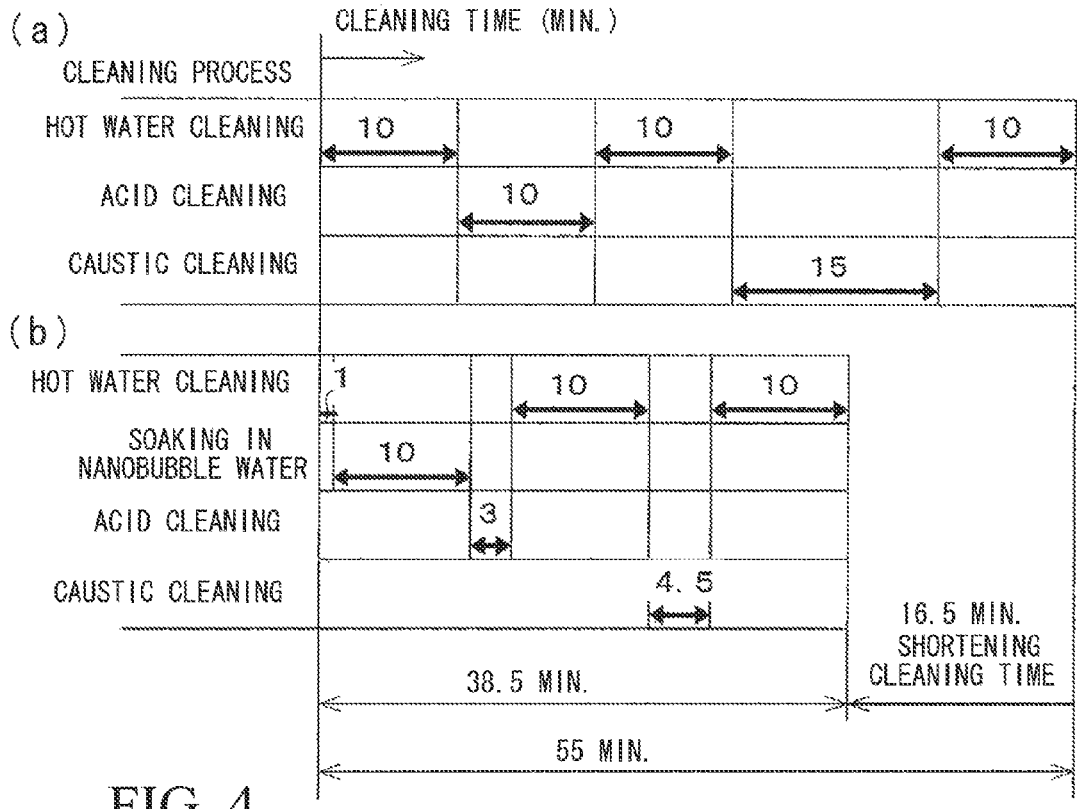
FIG. 3 is a view illustrating shortening of the time taken for on-site cleaning by the soaking of the nanobubble water of the invention, FIG. 3(*a*) shows an on-site cleaning process and cleaning time in the related art, and FIG. 3(*b*) shows an on-site cleaning process and cleaning time in the invention.

FIG. 3 is a view illustrating shortening of the time taken for on-site cleaning by the soaking of the nanobubble water of the invention, FIG. 3(*a*) shows an on-site cleaning process and cleaning time in the related art, and FIG. 3(*b*) shows an on-site cleaning process and cleaning time in the invention.

By an instrument-cleaning method using the on-site cleaning in the related art of FIG. 3(*a*), coffee grounds adhered on the equipment that had been filled with a coffee beverage were cleaned so that the times for hot water cleaning, acid cleaning, hot water cleaning, caustic cleaning, and hot water cleaning were set to 10 minutes, 10 minutes, 10 minutes, 15 minutes, and 10 minutes, respectively. Accordingly, the total cleaning time was 55 minutes.

Meanwhile, in the instrument-cleaning method using the on-site cleaning of the invention of FIG. 3(*b*), coffee grounds adhered on the equipment that had been filled with a coffee beverage were cleaned so that the times for hot water cleaning, the soaking of nanobubble water, acid cleaning, hot water cleaning, caustic cleaning, and hot water cleaning were set to 1 minute, 10 minutes, 3 minutes, 10 minutes, 4.5 minutes, and 10 minutes, respectively. Accordingly, the total cleaning time was 38.5 minutes.

As described above, as compared with the cleaning time of the instrument-cleaning method using the on-site cleaning in the related art, the cleaning time of the on-site cleaning of the liquid-treatment equipment 3, the filling equipment 4, and the pipe equipment 4*p* could be shortened by 16.5 minutes, that is, 30% due to the soaking of the nanobubble water. Accordingly, the consumption of an acid cleaning solution, a caustic cleaning solution, and hot water could be reduced.

Meanwhile, when the times for hot water cleaning, acid cleaning, hot water cleaning, caustic cleaning, and hot water cleaning were set to 1 minute, 3 minutes, 10 minutes, 4.5 minutes, and 10 minutes in the instrument-cleaning method using the on-site cleaning in the related art, the contaminants of the coffee grounds remained and adequate cleaning was not performed.

Further, the case where nanobubbles of which the diameter of an air bubble was 1 μm or less were used has been described in the above description, but there may also be a case where the contaminants of a liquid pathway are not worse in the case of a certain drinking beverage. In this case, microbubbles of which the diameter of a bubble is in the range of 10 to several tens of μm may be used, and the action of the microbubbles is the same as that when the nanobubbles are used. Accordingly, the detailed description thereof will be omitted.

Furthermore, nitrogen, ozone, and the like other than air may be used as the gas of the nanobubble or the microbubble. However, when ozone gas is used, a bactericidal effect and a deodorizing effect caused by ozone are added. Accordingly, the on-site cleaning of a filling solution line for a drinking beverage becomes effective.

Second Embodiment of the Invention

Next, a second embodiment of the invention will be described with reference to FIG. 4.

Figure 4:
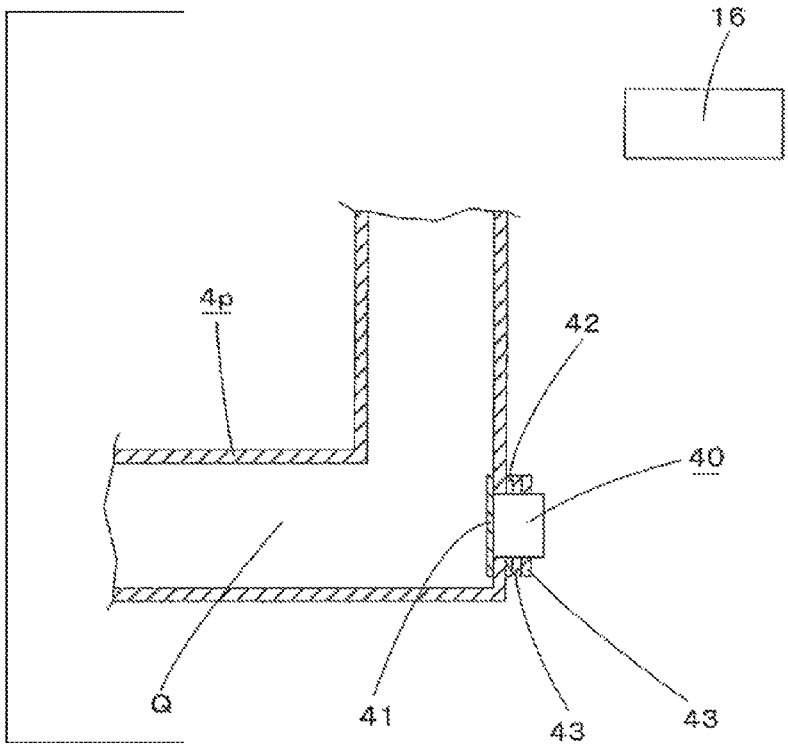
FIG. 4 is a partially enlarged view of equipment in which an instrument-cleaning method according to a second embodiment of the invention is implemented.

FIG. 4 is a partially enlarged view of equipment in which an instrument-cleaning method according to a second embodiment of the invention is incorporated.

In FIG. 4, the same portions as the portions of the first embodiment are denoted by the same reference numerals or not shown, and the repeated description thereof will be omitted. An ultrasonic oscillator 40 including a power supply terminal (not shown) is provided on pipe equipment 4*p*, and a vibrating surface 41 of the ultrasonic oscillator 40 is mounted on the pipe equipment with a packing 42 interposed therebetween by double fasteners 43 so as to face liquid Q. The ultrasonic oscillator 40 is adapted to be controlled by a control device 16.

Next, the action of the instrument-cleaning method according to the second embodiment of the invention will be described.

When the ultrasonic oscillator 40 generates ultrasonic waves for a prescribed period on the basis of commands sent from the control device 16 while the nanobubble water is left undisturbed to soak and applies ultrasonic vibration to the liquid-treatment equipment 3, the filling equipment 4, and the pipe equipment 4*p*, the separation of the contaminants D caused by the nanobubbles B shown in FIGS. 2(*b*) and 2(*c*) is facilitated and the movement of the separated contaminants D is facilitated. Accordingly, an effect of shortening the time for equipment cleaning and improving cleanliness is obtained.

INDUSTRIAL APPLICABILITY

In a cleaning method for on-site cleaning of equipment such as filling equipment that fills beverages, etc. into containers, such as bottles and cans, liquid-treatment equipment for filling solutions, or pipe equipment for connecting the equipment, it is possible to increase significantly the cleanliness of portions in contact with the filling solution while shortening cleaning time and reducing the amount of used utilities such as cleaning solution, etc.

DESCRIPTION OF REFERENCE NUMERALS

1: nanobubble water-generating device
2: nanobubble water tank
3: liquid-treatment equipment
4: filling equipment
4*p*: pipe equipment
15, 16: control device
40: ultrasonic oscillator
B: nanobubble
D: contamination

The invention claimed is:

1. An instrument-cleaning method for on-site cleaning liquid pathways including filling equipment that fills beverages into containers, liquid-treatment equipment for filling solutions, and pipe equipment connecting the filling equipment and the liquid-treatment equipment, the instrument-cleaning method comprising the steps of:

generating a liquid containing nanobubbles by applying a first ultrasonic vibration to a liquid;

cleaning the liquid pathways using first hot water;

pumping the liquid containing nanobubbles into the liquid pathways after the step of cleaning using the first hot water;

soaking and leaving undisturbed the liquid pathways in the liquid for a prescribed period after the liquid pathways have been filled with the liquid by the step of pumping the liquid containing nanobubbles;

applying a second ultrasonic vibration to the liquid containing nanobubbles during the step of soaking and leaving undisturbed the liquid pathways;

cleaning the liquid pathways using an acid cleaning solution after the step of soaking and leaving undisturbed the liquid pathways;

cleaning the liquid pathways using second hot water after the step of cleaning using the acid cleaning solution;

cleaning the liquid pathways using a caustic cleaning solution after the step of cleaning using the second hot water, and cleaning the liquid pathways using third hot water after the step of cleaning using the caustic cleaning solution, wherein a period of the step of cleaning the liquid pathways using the acid cleaning solution is shorter than a period of the step of cleaning the liquid pathways using the second hot water, wherein a period of the step of cleaning the liquid pathways using the caustic cleaning solution is shorter than a period of the step of cleaning the liquid pathways using the third hot water, and wherein the nanobubbles are adsorbed onto contaminants adhered on a surface of the liquid pathways by an absorption action of the nanobubbles during the step of soaking and leaving undisturbed the liquid pathways.

2. The instrument-cleaning method according to claim 1, wherein the nanobubbles are formed of ozone gas.

3. The instrument-cleaning method according to claim 1, wherein the nanobubbles are formed of nitrogen gas.

4. The instrument-cleaning method according to claim 1, further comprising the step of:

introducing the liquid containing nanobubbles into small gaps in the liquid pathways during at least one of the steps of soaking and leaving undisturbed the liquid pathways or applying a second ultrasonic vibration to the liquid.

5. The instrument-cleaning method according to claim 1, wherein the period of the step of cleaning the liquid pathways using the acid cleaning solution is 3/10 with respect to the period of the step of cleaning the liquid pathways using the second hot water.

6. The instrument-cleaning method according to claim 1, wherein the period of the step of cleaning the liquid pathways using the caustic cleaning solution is 9/20 with respect to the period of the step of cleaning the liquid pathways using the third hot water.

7. The instrument-cleaning method according to claim 1, wherein the prescribed period of the step of soaking and leaving undisturbed the liquid pathways is in the range of 1 to 30 minutes.

8. The instrument-cleaning method according to claim 7, wherein the nanobubbles are formed of ozone gas.

9. The instrument-cleaning method according to claim 1, further comprising:

cleaning the liquid pathways using a chemical after the step of soaking and leaving undisturbed the liquid pathways.

10. The instrument-cleaning method according to claim 9, wherein the nanobubbles are formed of ozone gas.

11. The instrument-cleaning method according to claim 9, wherein the prescribed period of the step of soaking and leaving undisturbed the liquid pathways is in the range of 1 to 30 minutes.

12. The instrument-cleaning method according to claim 11, wherein the nanobubbles are formed of ozone gas.

13. The instrument-cleaning method according to claim 1, wherein the liquid is water.

14. The instrument-cleaning method according to claim 13, wherein the nanobubbles are formed of ozone gas.

15. The instrument-cleaning method according to claim 13, wherein the prescribed period of the step of soaking and leaving undisturbed the liquid pathways is in the range of 1 to 30 minutes.

16. The instrument-cleaning method according to claim 15, wherein the nanobubbles are formed of ozone gas.

17. The instrument-cleaning method according to claim 13, further comprising:

cleaning the liquid pathways using a chemical after the step of soaking and leaving undisturbed the liquid pathways.

18. The instrument-cleaning method according to claim 17, wherein the nanobubbles are formed of ozone gas.

19. The instrument-cleaning method according to claim 17, wherein the prescribed period of the step of soaking and leaving undisturbed the liquid pathways is in the range of 1 to 30 minutes.

20. The instrument-cleaning method according to claim 19, wherein the nanobubbles are formed of ozone gas.

* * * * *